US007503454B2

(12) United States Patent
Gorman

(10) Patent No.: US 7,503,454 B2
(45) Date of Patent: Mar. 17, 2009

(54) MULTIFUNCTIONAL RECEPTACLE

(76) Inventor: Mike Gorman, 35 Kestrel Ct., Piqua, OH (US) 45356

( * ) Notice: Subject to any disclaimer, the term of this patent is extended or adjusted under 35 U.S.C. 154(b) by 398 days.

(21) Appl. No.: 10/904,484

(22) Filed: Nov. 12, 2004

(65) Prior Publication Data

US 2005/0098459 A1 May 12, 2005

Related U.S. Application Data

(63) Continuation-in-part of application No. 10/706,534, filed on Nov. 12, 2003, now abandoned.

(60) Provisional application No. 60/425,487, filed on Nov. 12, 2002.

(51) Int. Cl.
*A45C 11/26* (2006.01)

(52) U.S. Cl. ..... 206/349; 206/527

(58) Field of Classification Search ..... 206/527, 206/372–379, 349; 182/129; 220/570, 694, 220/751, 756, 772–776
See application file for complete search history.

(56) References Cited

U.S. PATENT DOCUMENTS 3,837,034 A * 9/1974 Leffert et al. ..... 15/257.06
4,383,669 A * 5/1983 Rasler ..... 248/210
5,191,954 A * 3/1993 Ledford ..... 182/129
5,505,302 A * 4/1996 Ferley ..... 206/373
5,901,998 A * 5/1999 Gallo, Jr. ..... 294/143
5,941,344 A * 8/1999 Spadaro ..... 182/129
5,950,972 A * 9/1999 Irish ..... 248/210
5,967,259 A * 10/1999 Williams ..... 182/129
6,722,469 B1 * 4/2004 Weger, Jr. ..... 182/107

FOREIGN PATENT DOCUMENTS

GB 2193523 A * 2/1988

* cited by examiner

*Primary Examiner*—J. Gregory Pickett
(74) *Attorney, Agent, or Firm*—R. William Graham

(57) ABSTRACT

A multifunctional receptacle for use on a step ladder includes a base member having a bottom side with a recessed surface to complementary receive a step surface of the ladder in a manner to prevent at least one degree of movement therebetween when the base member is disposed on the step. The receptacle includes at least one side member, preferably opposing side members, extending upward from the bottom side forming a storage compartment. The storage member can include a substantially rectangular storage compartment, and a substantially circular storage compartment. The receptacle can also include a hook for retaining a conventional roller paint tray.

8 Claims, 5 Drawing Sheets

101
119
111
113

123
121
155A
200
133
109
129
153A
103
145A
S
127
137A
151
L
136
115
125
143
131
145B
141
101
115

155B
113
153B
107
S
137A
138B
137B
138 A
139A
139B
135

MULTIFUNCTIONAL RECEPTACLE

This application is a continuation-in-part of application Ser. No. 10/706,534 filed Nov. 12, 2003 now abandoned which is continuing from provisional application filed Nov. 12, 2002 having Ser. No. 60/425,487 and claims the benefits thereof.

BACKGROUND OF THE INVENTION

The present invention relates generally to an apparatus for use in home improvement projects and, more particularly, to a multifunctional receptacle for use on a step ladder.

SUMMARY OF THE INVENTION

It is an object to aid in carrying apparatus relating to home improvement.

Accordingly, the invention relates to a multifunctional receptacle for use on a step ladder which includes a base member having a bottom side with a recessed surface configured to receive a step surface of the ladder in a complementary manner to prevent at least one degree of movement therebetween when the base member is disposed on the step. The base member includes at least one side member, preferably opposing side members, extending upward from the bottom side forming a storage compartment. The multifunctional receptacle can include one or more substantially rectangular storage compartments, and one or more storage compartments to retain cylindrical containers in a manner to prevent tipping thereof. The receptacle can also include a hook connected to the base member for retaining a conventional roller paint tray.

The multifunctional receptacle can include a handle connected to the side member, which can be generally a U-shaped handle having a transverse member and two opposing parallel side arms extending therefrom in a first direction, wherein each side arm is pivotally connected to one side member. The transverse member includes a hooked arm extending therefrom in another direction from the first direction to enable the receptacle to hang from a rung of a ladder. A second generally U-shaped handle can be provided having a transverse member and two opposing parallel side arms extending therefrom in a common first direction, wherein each side arm is pivotally connected to one side member. The transverse member of the first U-shaped handle includes a retaining hook extending therefrom which is configured to removably retain the transverse member of the second U-shaped handle.

A preferred embodiment is directed to a multifunctional receptacle which is suited for use on a ladder having a set of steps. The receptacle includes a base member having upper side members and a bottom side with a lower portion thereof defining a recessed surface extending through the side members providing a forward retention lip and rear retention lip and configured to complementary receive a step surface of the ladder in a manner to prevent at least one degree of front and rear movement therebetween when the base member is disposed on the step; and a first side member and an opposing second side member extending upward from the bottom side forming part of a storage compartment, a first generally U-shaped handle having a transverse member and two opposing parallel side arms extending therefrom in a first direction, wherein each side arm is pivotally connected to the storage compartment adjacent the first side member, a second generally U-shaped handle having a transverse member and two opposing parallel side arms extending therefrom in a common first direction, wherein each side arm is pivotally connected to the storage compartment adjacent the second side member. The U-shaped handles are configured to move between a first position wherein the transverse members are disposed adjacent one another and wherein the transverse member of the first U-shaped handle includes an integrally connected retaining hook extending therefrom which is configured to removably retain the transverse member of the second U-shaped handle and a second position wherein the arms of the U-shaped handles are configured to be disposed against the ladder when the base is disposed on a step of the ladder.

A strap, which can preferably be flexible and stretchable, such as an elastic cord, having a connector, such as a hook, at each end of the strap is provided wherein one hook connects to one side member, the strap extends beneath the step on which the base member sits and the other hook connects to another side to further secure receptacle to the step. The side members can be formed with hook receiving surfaces to receive the hooks.

Other objects and advantages will be readily apparent to those skilled in the art upon viewing the drawings and reading the detailed description hereafter.

BRIEF DESCRIPTION OF THE DRAWINGS

The following detailed description of the embodiments of the present invention can be best understood when read in conjunction with the following drawings, where like structure is indicated with like reference numerals and in which.

Figures 1A, 1B:
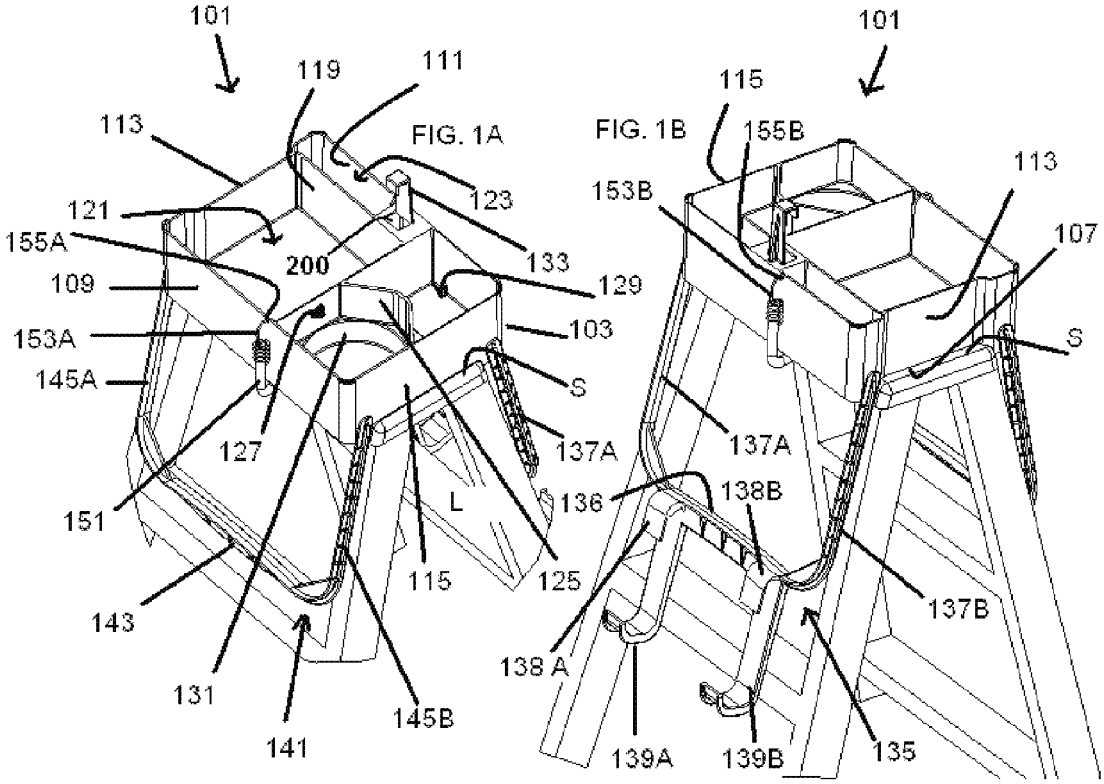
FIG. 1A is a perspective view of a multifunctional receptacle of the present invention on a ladder.
FIG. 1B is another perspective view of a multifunctional receptacle of the present invention on a ladder.
Figure 2:
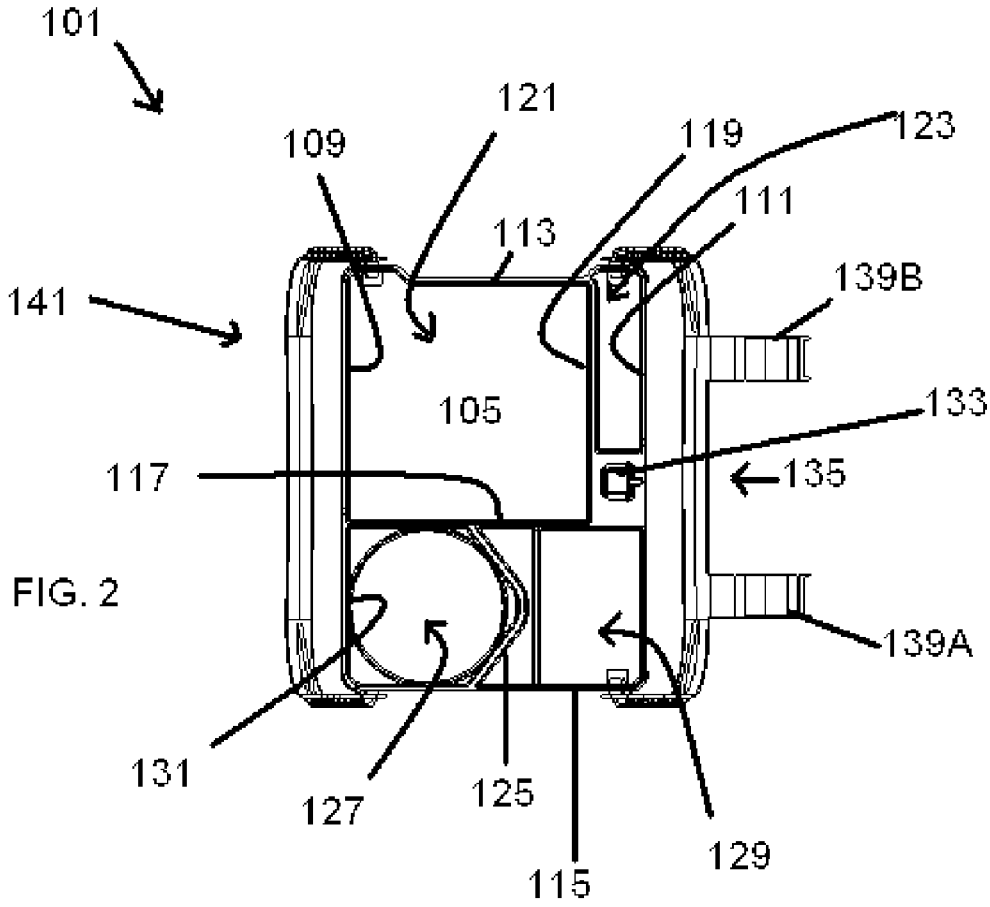
FIG. 2 is a is a top view of the multifunctional receptacle of the present invention.
Figure 3:
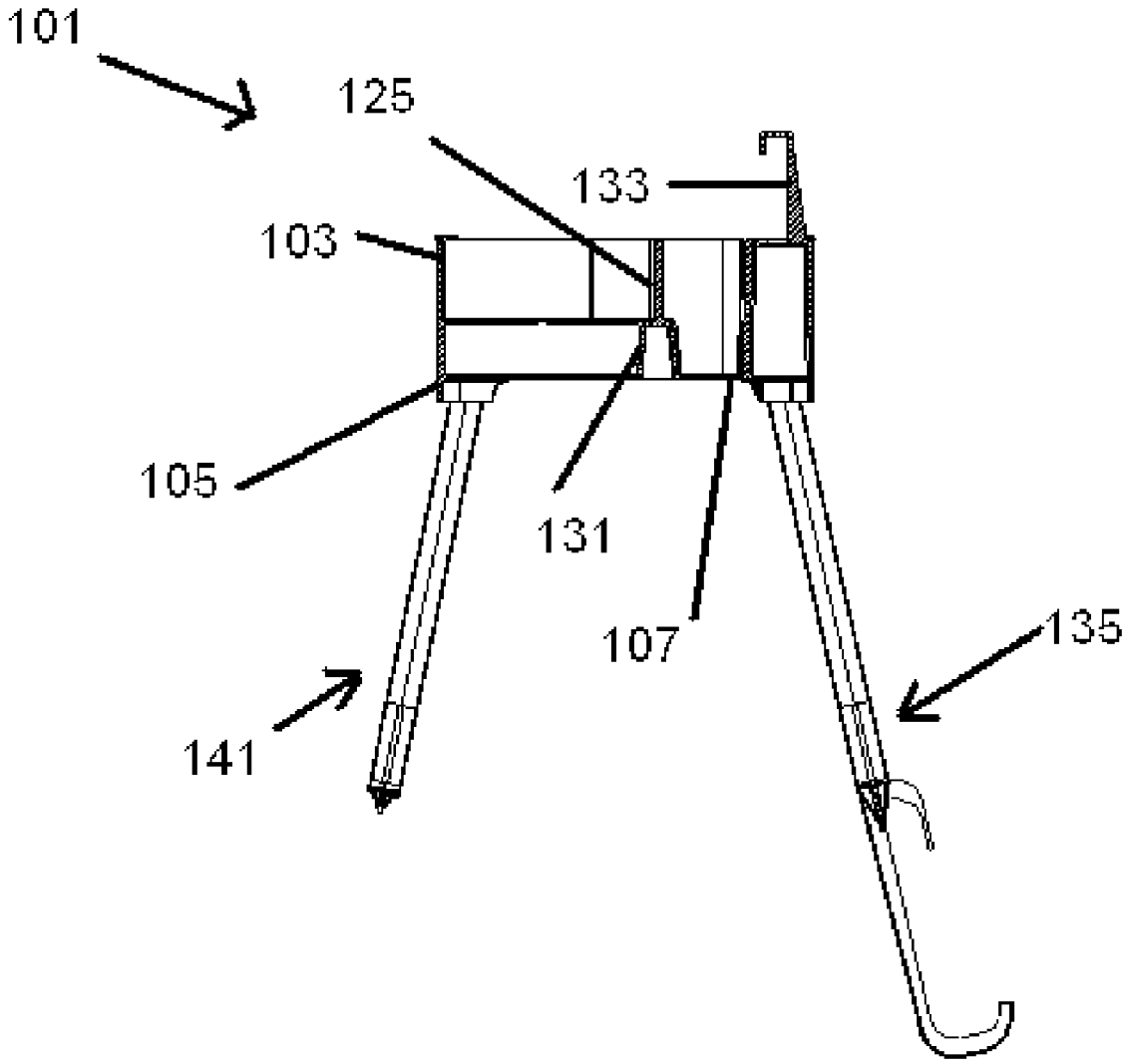
FIG. 3 is a side view of the multifunctional receptacle of the present invention.
Figure 4:
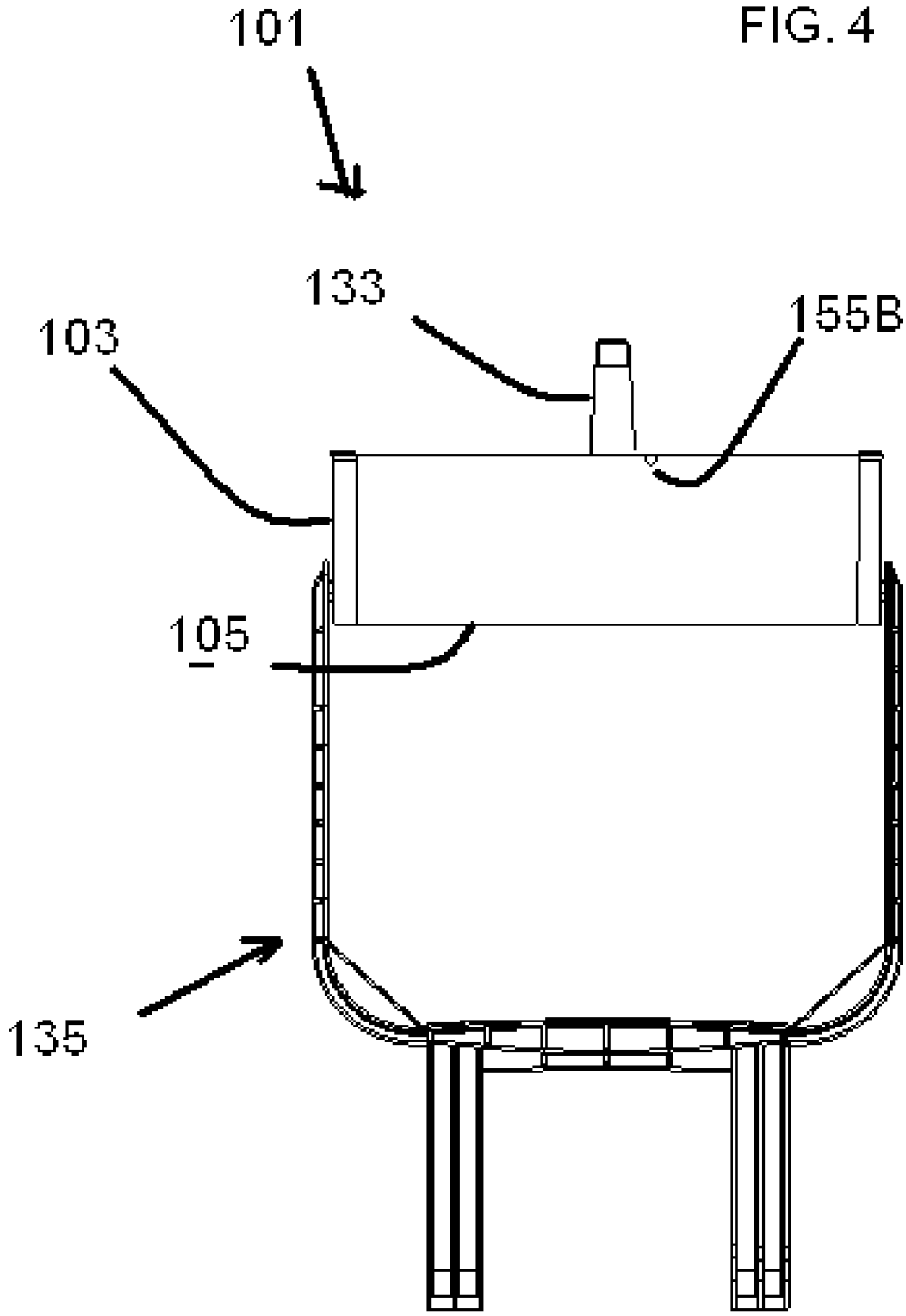
FIG. 4 is another side view of the multifunctional receptacle of the present invention.

Skilled artisans appreciate that elements in the figures are illustrated for simplicity and clarity and have not necessarily been drawn to scale. For example, the dimensions of some of the elements in the figures may be exaggerated relative to other elements to help to improve understanding of the embodiments of the present invention.

DETAILED DESCRIPTION OF SOME EMBODIMENTS OF THE INVENTION

Home improvement projects both within and outside of the home necessitate the use of a variety of tools and materials. To ensure that projects proceed to completion in a safe and efficient manner, it is necessary that the materials (i.e., tools, paint. stain, adhesives. calk, tape, etc.) are stored in close proximity to the user. Because certain jobs require the use of a ladder, such as painting a ceiling, there is a need for a device which can be disposed on the ladder for storage of paint and other materials for immediate and repeated use while standing on or adjacent the ladder. Such a device does away with placing tools and materials on the ground and requiring one to climb off of the ladder every time they are in need of more paint or another object or material thereby conserving time and energy and fostering safety. Accordingly, the inventor has recognized a need for improvements in the design of receptacles for home improvement materials.

The present invention meets the above-mentioned need by providing a multifunctional receptacle particularly useful on a ladder. Although the present invention is not limited to specific advantages or functionality, it is noted that the receptacle can be placed on and secured to a step of a ladder, such as a top step, with minimal risk of spilling its contents.

Referring to FIGS. 1A-5, a multifunctional receptacle 101 is provided comprising a base member 103 having a bottom side 105 with a recessed surface 107 configured to complementary receive an upper step surface S of the ladder L in a manner to prevent at least one degree of movement therebetween when the base member 103 is disposed on the step surface S. Here, the recessed surface 107 is slightly larger than the width of the step surface S. The base member 103 includes a plurality of interconnecting upper side members 109, 111, 113 115, wherein side members 109 and 111 are opposing, and side members 113 and 115 are opposing having the recessed surface 107 extending therethrough thereby forming a forward retention lip and a rear retention lip, and extend upward from the bottom side 105. A partition member 117 interconnects side members 109 and 111 and extends upward from the bottom side 105 and a transverse side member 119 interconnects side member 113 and partition 117 and extends upward from the bottom side 105 forming a first rectangular storage compartment 121 that can be dimensioned for holding a square gallon size container of paint, stain or another material and a second rectangular storage compartment 123 that can be employed in holding tools and home improvement materials (i.e., calk gun; scraper, screw driver, paint can opener, rags. and tape, a paint brush handle (bristles facing upwards)). An angled transverse side member 125 interconnects side member 115 and partition 117 forming a third storage compartment 127 that can be dimensioned for holding a gallon size can of paint, stain or another material which is configured to retain a cylindrical can of paint in a manner to substantially prevent the same from tipping therein and a fourth utility storage compartment 129 that can be employed for holding a quart size can of paint or any other conceivable vessel or material (i.e., a beverage, paint remover, spackle, etc.). The inventor notes that the invention is not limited to any particular number, size or shape of storage compartments, which can be used to hold virtually another object or material. A generally cylindrical wall surface 131 can also be provided within the compartment 127 which extends upward from the bottom side 105 to further aid retention of a cylindrical container.

The receptacle 101 can also include a hook 133 adjacent compartment 123 for retaining a conventional roller paint tray (not shown). The hook 133 retains the tray atop the receptacle 101 by resting on side member 109 and partition 117.

Figure 5:
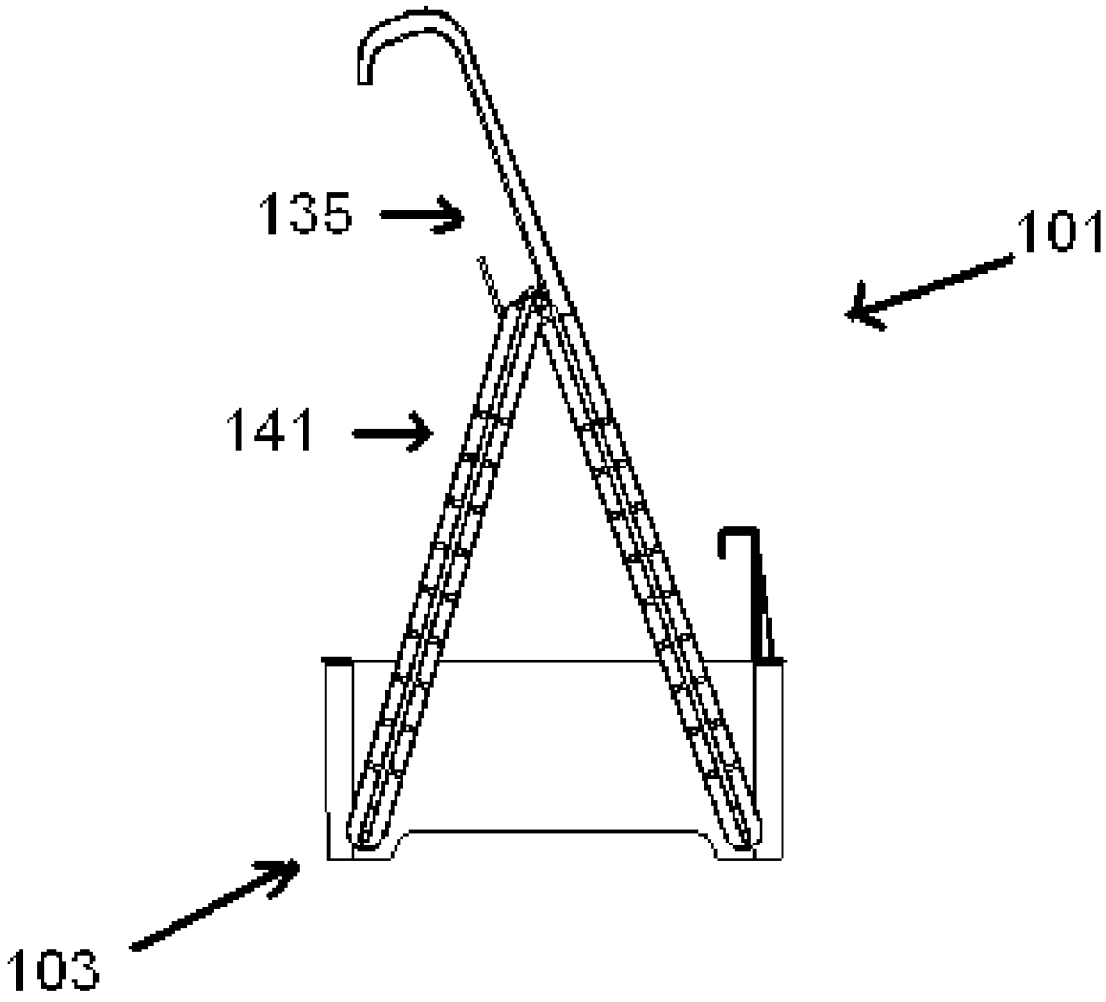
FIG. 5 is yet another side view of the multifunctional receptacle of the present invention.

The multifunctional receptacle 101 can include a handle 135 connected to the side members 113 and 115, which can be generally a U-shaped handle having a transverse member 136 and two opposing parallel side arms 137A, 137B extending therefrom in a first direction, wherein each side arm 137A, 137B is pivotally connected to one of the side members 115 and 113. The transverse member 136 includes hooked arms 139A and 139B extending therefrom in another direction from the first direction to enable the receptacle to hang from a rung of the ladder. A second generally U-shaped handle 141 has a transverse member 143 and two opposing parallel side arms 145A and 145B extending therefrom in a common first direction, wherein each side arm 145A and 145B is pivotally connected to one of the side members 113 and 115. Further, the transverse member of the first U-shaped handle 135 includes retaining hooks 138A and 138B extending therefrom which is configured to removably retain the transverse member 143 of the second U-shaped handle 141 as seen in FIG. 5.

A strap 151, which can preferably be flexible and stretchable, such as an elastic cord, having connectors 153A, 153B, such as a hook, at each end of the strap 151 is provided wherein one hook 153A connects to one side member 109, the strap 151 extends beneath the step surface S on which the bottom side 105 sits and the other hook 153B connects to side member 111 to further secure receptacle 101 to the step. The side members 109 and 111 can be formed with hook receiving surfaces 155A and 155B to receive the hooks 153A and 153B.

The receptacle 101 can further include a foam rubber mat material on the underside of the bottom side 107, which assists in holding the receptacle 101 in place. The mat material, which can be approximately ½" thick, can be, for example, adhesively applied to the underside of the bottom side 107 by a pressure sensitive adhesive (PSA).

While the invention has been described by reference to certain embodiments, is should be understood that numerous changes could be made within the spirit end scope of the inventive concepts described. Accordingly, it is intended that the invention not be limited to the disclosed embodiments, but that is have the full scope permitted by the language of the following claims.

What is claimed is:

1. A multifunctional receptacle which is suited for use on a ladder having a set of steps, which includes:

a base member having a plurality of interconnecting upwardly extending side members which form part of a storage compartment, said side members including a first pair of opposing side members and a second pair of opposing side members, said base member further including a bottom side forming another part of said storage compartment with a lower portion thereof defining a recessed surface extending through said first pair of opposing side members providing a forward retention lip and rear retention lip and configured to complementary receive a step surface of the ladder in a manner to prevent at least one degree of front and rear movement therebetween when said base member is disposed on the step and wherein one of said second pair of opposing side members is characterized as a forward side member and another of said second pair of opposing side members is characterized as a rear side member and wherein said first pair of opposing side members is characterized to include a first side member and a second side member;

a first generally U-shaped handle having a transverse member and two opposing parallel side arms extending therefrom in a first direction, said side arms including a first side arm and second side arm and wherein said first side arm is pivotally connected to said first side member proximate said forward side member and said bottom side and a second side arm is pivotally connected to said second side member proximate said forward side member and said bottom side;

a second generally U-shaped handle having a transverse member and two opposing parallel side arms extending therefrom in a common first direction, said side arms including a first side arm and second side arm and wherein said first side arm is pivotally connected to said first side member proximate said rear side member and said bottom side and a second side arm is pivotally connected to said second side member proximate said rear side member and said bottom side and wherein said first side arms are spaced apart a distance between said pivotal connections to said first side member and said second side arms are spaced apart a distance between said pivotal connections to said second side member;

said U-shaped handles are configured to move between a first position wherein said transverse members are disposed adjacent one another above said storage compartment and wherein said transverse member of said first U-shaped handle includes an integrally connected retaining hook extending therefrom which is configured to removably retain said transverse member of said second U-shaped handle and a second position wherein said arms of said U-shaped handles are configured to move below said storage compartment and be disposed against the ladder when said base is disposed on a step of the ladder.

2. The multifunctional receptacle of claim 1, wherein said storage compartment includes a substantially rectangular storage compartment.

3. The multifunctional receptacle of claim 1, wherein said storage compartment includes a storage compartment configured to retain a cylindrical container in a manner to prevent tipping thereof within said compartment.

4. The multifunctional receptacle of claim 1, which includes a hook for retaining a conventional roller paint tray on top of said receptacle.

5. The multifunctional receptacle of claim 1, wherein one of said transverse members includes an integrally connected hooked arm extending to enable said receptacle to hang from a step of the ladder when in said first position and when said handles are in said second position provides a hook from which to hang articles.

6. The multifunctional receptacle of claim 1, which includes a strap having a connector at each end of the strap wherein one connector connects to one portion of said side member, said strap is of a length to extend beneath the step on which said base member sits and said other connector connects to another portion of said side to secure receptacle to the step.

7. The multifunctional receptacle of claim 6, wherein said side member is formed with connector receiving surfaces to receive said connectors.

8. The multifunctional receptacle of claim 6, wherein said strap is flexible and stretchable.

* * * * *